US011896090B2

(12) United States Patent
Fung

(10) Patent No.: US 11,896,090 B2
(45) Date of Patent: Feb. 13, 2024

(54) HOOK TAPE AND AN EYE TAPE FOR USE IN GARMENTS AND METHOD OF MAKING THE SAME

(71) Applicant: Multi Trend Corporation Limited, Kowloon (HK)

(72) Inventor: Wing Leung Fung, Kowloon (HK)

(73) Assignee: MULTI TREND CORPORATION LIMITED, Kowloon (HK)

( * ) Notice: Subject to any disclaimer, the term of this patent is extended or adjusted under 35 U.S.C. 154(b) by 210 days.

(21) Appl. No.: 17/366,714

(22) Filed: Jul. 2, 2021

(65) Prior Publication Data

US 2023/0000215 A1 Jan. 5, 2023

(51) Int. Cl.
*A44B 13/00* (2006.01)
*A41F 1/00* (2006.01)

(52) U.S. Cl.
CPC ..... *A44B 13/0052* (2013.01); *A41F 1/006* (2013.01); *A44B 13/0011* (2013.01)

(58) Field of Classification Search
CPC ..... A44B 13/0052; A44B 13/0011; A44B 13/0029; A41F 1/006
See application file for complete search history.

(56) References Cited

U.S. PATENT DOCUMENTS 2,861,276 A * 11/1958 Alfandre ..... A44B 13/0011 2/325
3,530,813 A * 9/1970 Roseman ..... A44B 13/0011 2/265
3,575,750 A * 4/1971 Sakamoto ..... A44B 13/0052 156/324
4,025,374 A * 5/1977 Spindler ..... B29C 66/80 156/251
6,431,947 B1 * 8/2002 Henz ..... A41F 15/002 450/86
7,918,711 B2 * 4/2011 Yeung ..... A41F 1/006 24/DIG. 43
2009/0199368 A1 * 8/2009 Gut ..... A41F 1/006 24/369
2009/0223029 A1 * 9/2009 Leung ..... A41F 1/006 83/13
2010/0248588 A1 * 9/2010 Knittel ..... A41F 1/006 450/82
2013/0199005 A1 * 8/2013 Fung ..... A44B 13/0011 24/698.2
2019/0357636 A1 * 11/2019 Utaka ..... F16B 45/00

* cited by examiner

*Primary Examiner* — David M Upchurch
(74) *Attorney, Agent, or Firm* — MICHAEL BEST & FRIEDRICH LLP

(57) ABSTRACT

A hook or eye tape comprising a body including a backing member; a connector arranged on the body and the connector has a first part; and a main seamless connection formed between the first part of the connector and a corresponding portion of the backing member to secure the connector at a desired position on the body; and the method of making the same.

17 Claims, 13 Drawing Sheets

100
110
108

100
101
103B
A'
A
109

110
101
103B
108
103B
109

102
102A
102B
102C
104
101
108
108A
108B
103A
301
110

HOOK TAPE AND AN EYE TAPE FOR USE IN GARMENTS AND METHOD OF MAKING THE SAME

The present invention relates to a hook and eye tape for use in garments, for example particularly, but not exclusively, a seamless hook and eye tape for use in an undergarment such as brassiere.

BACKGROUND OF THE INVENTION

Hook and eye closure is commonly used in garments as a secure method for fastening parts of the garments together such that the piece of garment can be dressed comfortably and securely on a wearer. The hook and eye closure has a long history and is still used today, primarily on brassiere.

Mass production of hook and eye closure was made possible in 1800s by an innovator who commissioned the creation of a machine that automated the formation of hook and eye fasteners. Since that wired hook and eye are sewed onto the garment to function as closures. The fasteners were eventually manufactured in the form of hook-and-eye tape, consisting of two tapes, one with hooks and the other with eyelets. The tapes are sewed onto either side of a garment closure such that they can be connected side-by-side closing the garment closure. Nowadays, the hook-and-eye closures come as individual straps or as ready-to-cut tapes.

Each tape is a laminated structure made of various materials. Each layer of material is functionally specific and has different physical characteristics. As such, each layer may be formed from a different material to provide the required physical characteristic. For example, the backing member is there to support the hooks or eyelets. It has to be strong and rigid. As for the outermost layer behind the backing member, it has to be soft and comfortable as a layer that touches the skin of a user. A cushioning layer may be applied between the backing member and the outermost layer to mask the hardness of the hooks or eyelets. The cushioning layer is flexible and relatively thick. The hooks and eyelets are sewed onto the backing member and different layers are sewed onto the hooks and eyelets for fixing the relative positions between them.

The manufacturing of a hook and eye tape is a complication process and procedurally cumbersome. Furthermore, all of the different materials in the tape add on to the difficulties in recycling of the tape for the sake of our environment. The extra costs and efforts required to recycle the hook and eye tapes are the main deters.

The invention seeks to eliminate or at least to mitigate such shortcomings by providing an improved hook and eye tape.

SUMMARY OF THE INVENTION

In a first aspect of the invention there is provided a hook or eye tape comprising: a body including a backing member; a connector arranged on the body and the connector has a first part; and a main seamless connection formed between the first part of the connector and a corresponding portion of the backing member to secure the connector at a desired position on the body; Preferably, the body is a laminated body including a cover member, the first part of the connector is sandwiched between the cover member and the backing member; more preferably, the main seamless connection joins the first part of the connector to corresponding portions of the backing member and the cover member such that the first part of the connector is sandwiched there between; it is preferable that the seamless connection further includes an auxiliary seamless connection formed between corresponding portions of the backing member and the cover member at a position peripheral to the main seamless connection; Advantageously, at least one of the main seamless connection and the auxiliary seamless connection comprises a weld; more advantageously, the main seamless connection is a weld that joins the corresponding portions of the backing member and the cover member thereby fixing the position of the first part of the connector on the body; yet more advantageously, the backing member, the cover member as well as the first part of the connector are fused at the weld; yet more advantageously, the welds are ultrasonic welds formed by way of ultrasonic welding; it is preferable that the main seamless connection comprises an attachment region that involves the application of adhesive at the attachment region; preferably, the adhesive is a heat sensitive adhesive; more preferably, at least one of the backing member and the cover member comprises a layer of heat sensitive adhesive material; yet more preferably, the hook or eye tape includes at least two connectors each being secured to the body via respective main seamless connections which are spatially separated from each other on the body which is laminated; more preferably. the main seamless connection has a well-defined boundary that runs in proximity to and around the first part of the connector; advantageously, the auxiliary seamless connection is provided between two main seamless connections for fixing the cover member to the backing member; more advantageously, an opening is formed between the backing member and the cover layer via which a second part of the connector protrudes; yet more advantageously, the opening is formed at an edge of the cover member, along which an auxiliary seamless connection is provided to fix the cover layer to the backing member adjacent the opening; preferably, the cover member includes an outer cover layer with preformed apertures via which a second part of the connector protrudes; more preferably, the body includes two opposite ultrasonically welded edges, the cover member further includes an outermost cover layer provided underneath the backing member, the outermost cover layer conceals the welded edges of the body; yet more preferably, the outer cover layer is attached to the cover member and the backing member via respective adhesive layers.

In a second aspect of the invention there is provided a method of manufacturing a hook or eye tape comprising the step of: arranging a hook or an eye on a backing member, and seamlessly connecting the hook or eye on the backing member; preferably the method further comprising the step of arranging a cover member on top of the backing member for sandwiching at least a first portion of the hook or eye therebetween; yet more preferably, the first portion is seamlessly connected to the backing member and the cover member; it is preferable that the method, further comprising the step of providing an outer cover layer on which apertures are preformed, placing the outer cover layer on the cover member and inserting a second portion of the hook or eye through the aperture; preferably, the hook or eye is seamlessly connected by way of ultrasonic welding; more preferably, the hook or eye is seamlessly connected to the backing member by an adhesive. It is preferable that the outer cover layer has an upper layer and a lower layer, the apertures are preformed on the upper layer; advantageously, the method further comprises the step of attaching the upper layer to the cover member with the lower layer being placed immediately adjacent the upper layer; yet more advantageously, the method further comprises the step of flipping the lower layer such that the lower layer is turned inside out and is placed immediately adjacent the backing member.

BRIEF DESCRIPTION OF DRAWINGS

The invention will now be more particularly described, by way of example only, with reference to the accompanying drawings.

DETAILED DESCRIPTION OF PREFERRED EMBODIMENT

A first aspect of the invention relates to a hook tape and an eye tape and a second aspect of the invention relations to a method of making the same. The hook or eye tape in accordance with the invention has a seamless construction. Connections of various parts are made possible by seamless means so as to avoid any stitches. The use of seamless connection reduces the cost of production as the manufacturing procedure is simplified. It is also the intention to minimize the number of different materials used in forming the tape. Such a tape is more environmentally friendly by becoming more recycle ready.

Figure 1B:
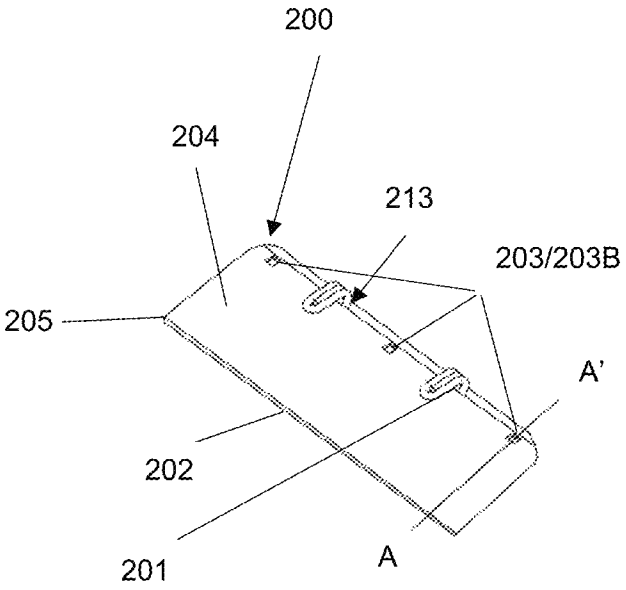
FIG. 1B is a drawing of a first embodiment of a hook tape in accordance with the invention.
Figure 1A:
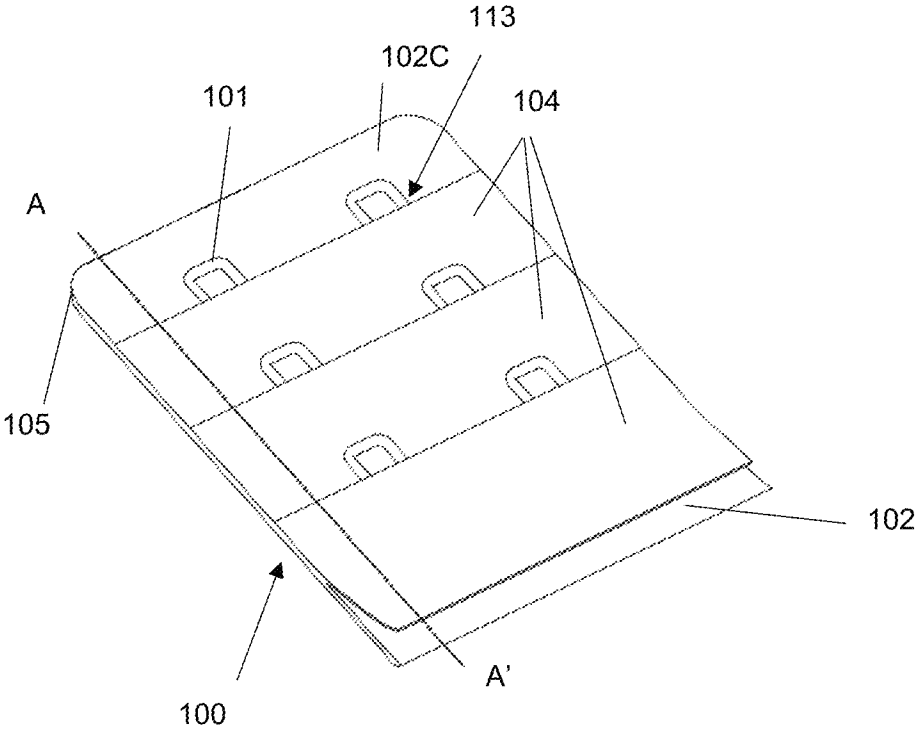
FIG. 1A is a drawing of a first embodiment of an eye tape in accordance with the invention.

In general, the eye tape 100 includes a body having a backing member 102. The body of the eye tape 100 is indicated by reference number 105 (FIG. 1A). Eye connectors 101, also known as eyelets, are provided on the backing member 102. Each of the eyelets 101 has a first part, the legs portion and the second part, the eye portion. Seamless connection 103/203 is formed at least between the legs of the eyelet 101 and a corresponding portion of the backing member 102 to secure the eyelet 101 at a desired position on the body.

The hook tape 200 also includes a body with a backing member 202. The body of the hook tape 200 is indicated by reference number 205 (FIG. 1B). Hook connectors, or hooks, 201 are provided on the backing member 202. Each hook 201 has a first part, the legs portion and the second part, the hook portion. Seamless connection 103/203 is formed at least between the legs portion of the hook 201 and a corresponding portion of the backing member 202 to secure the hook 201 at a desired position on the body.

The body of the hook and eye tapes 200 and 100 may be a laminated body making up of various layers of materials.

The seamless connection 103/203 has well defined boundary and the shape of which may vary.

The hook and eye 201 and 101 are one-piece metallic connectors made from respective wires which has uniform thickens along length. The seamless connection 103/203 is formed either by way of ultrasonic welding or by the application of adhesive. In an embodiment of the invention, the seamless connection, is fused with or attached to the backing member 202 or 102 and may further fused with or attached to a cover member 204 or 104.

The hook and eye tapes 200 and 100 are useful in undergarment and more specifically a brassiere to connect two bends of the brassiere together.

Referring to FIGS. 1A, 1B, 2, 3A, 3B, 4A and 4B, there is shown a first embodiment of an eye tape 100 and a corresponding hook tape 200 for forming a closure. As shown in FIGS. 1A, an individual eye tape 100 may include three rows of two eyelets 101. The eyelets 101 in each row are spatially separated from each other. FIG. 1B shows a corresponding individual hook tape 200 which includes one row of two hooks 201. The positions of the hooks 201 on the hook tape 200 correspond to the positions of the eyelets 101 in each row such that the hooks 201 and eyelets 101 can be readily coupled to form a closure.

The individual hook tape 200 and individual eye tape 100 are formed by segregation of a continuous hook tape and eye tape respectively. In the individual eye tape 100, the left and right sides, are sealed. The sealing of each side is simultaneous with the segregation. With reference to FIG. 1A, a rear end portion of the left and right sides of the individual eye tape 100 is left unseal, together with the opened bottom, they form an open end portion 100A for sewing onto an undergarment. As for the hook tape, again, the left and right sides, are fully sealed. Rear end of the hook tape 200 remains unseal for sewing onto an undergarment. The sealing and segregation are preferably simultaneous step and performed by way of ultrasonic welding and cutting.

Figure 2:
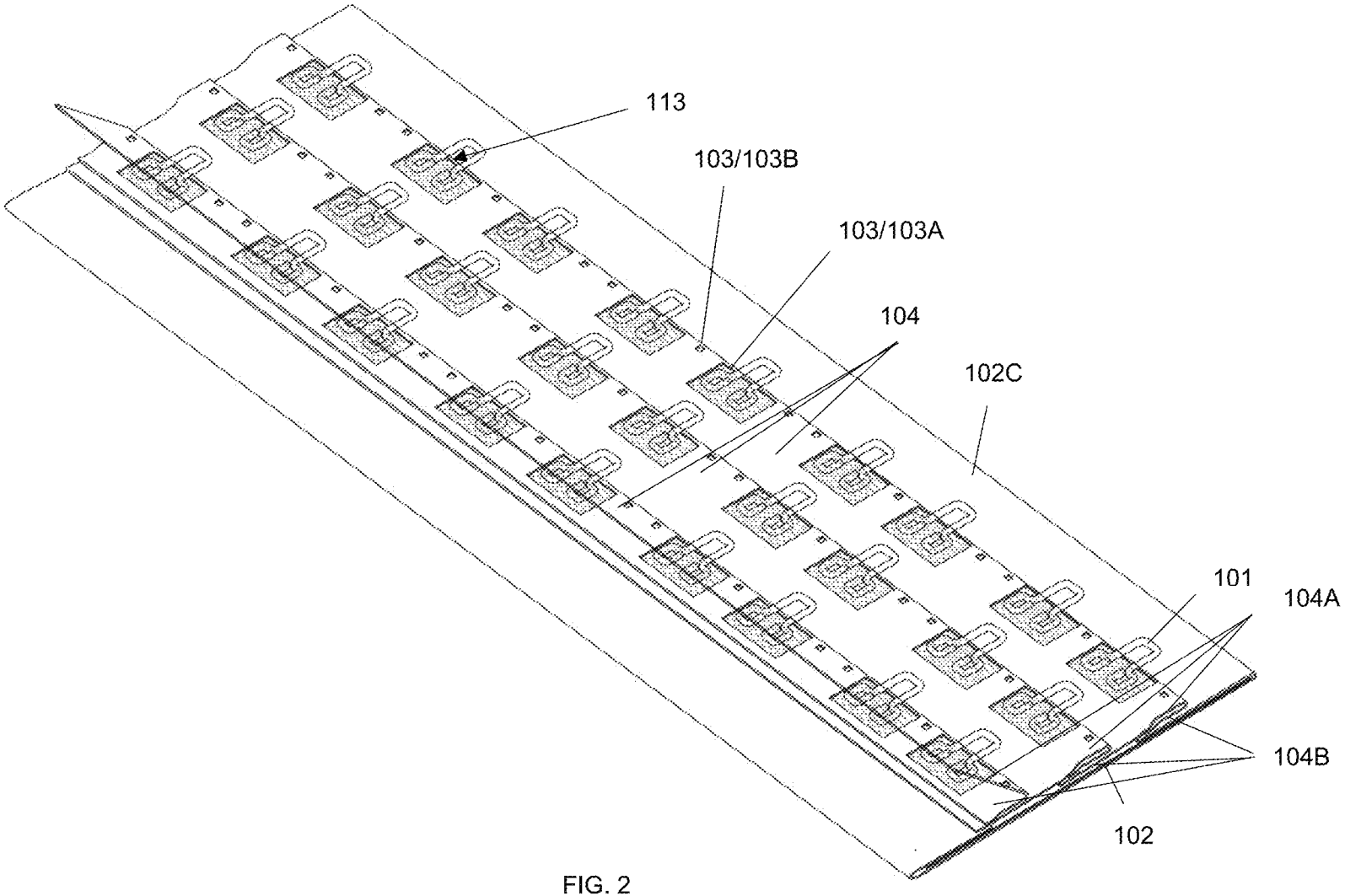
FIG. 2 is a drawing of the first embodiment of a continuous strap of the eye tapes in FIG. 1 with the uppermost layer shown transparent to reveal seamless connections.
Figure 3A:
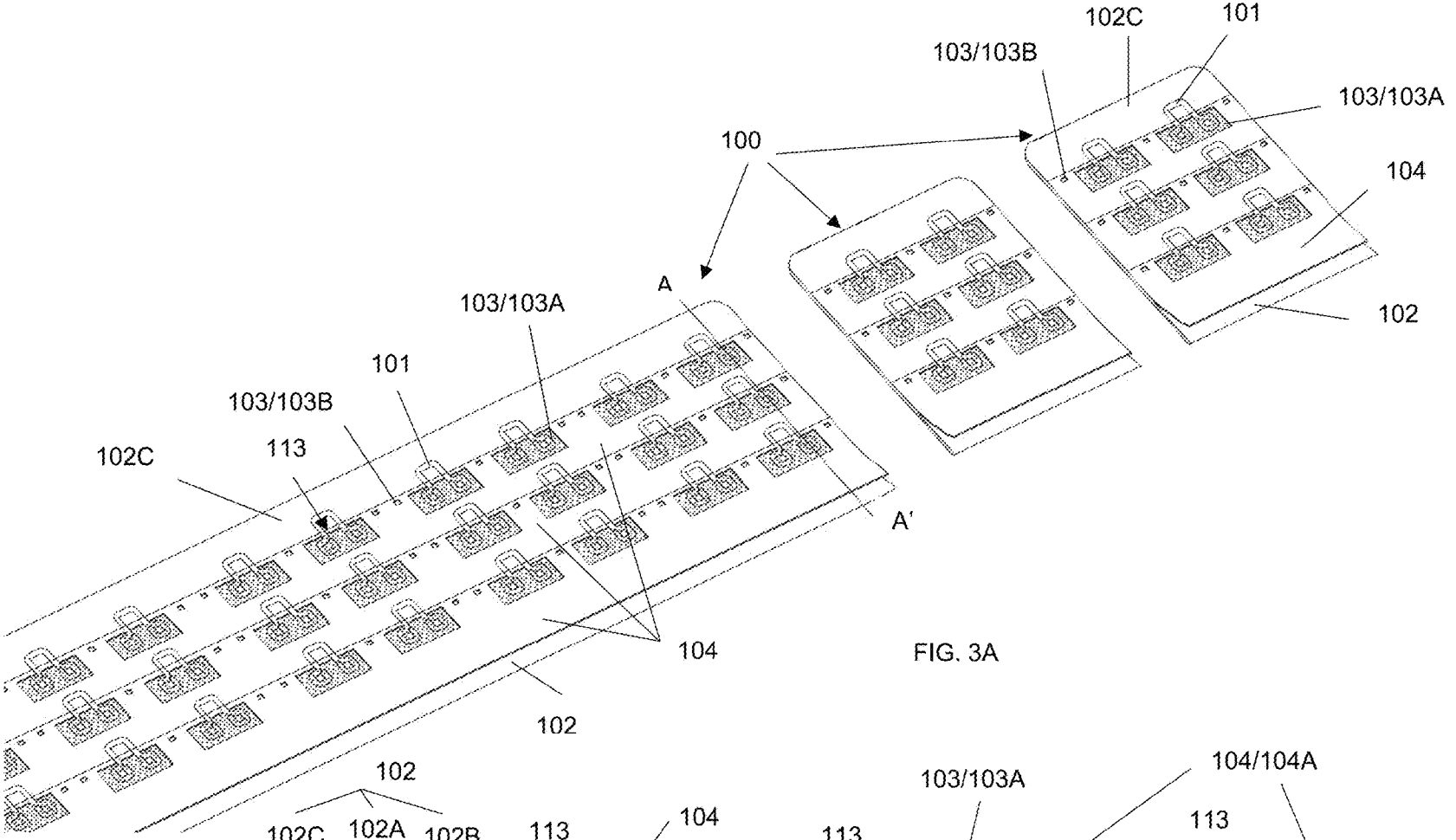
FIG. 3A is a drawing showing the strap of eye tapes in FIG. 2 being segregated into individual eye tapes.
Figure 3B:
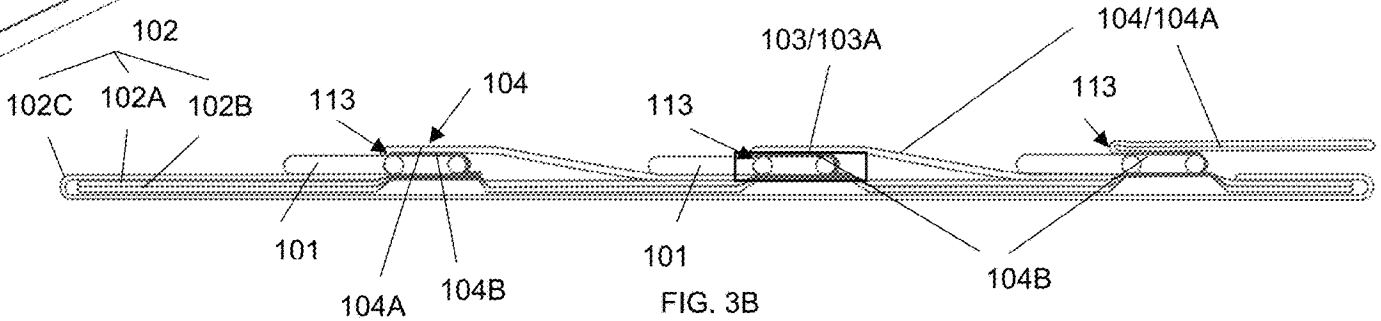
FIG. 3B is a cross-sectional view of the eye tape in FIG. 3A take along line A-A' thereof.

With reference to FIGS. 2, 3A and 3B, in each individual eye tape 100, the eyelets 101 are fixed to a backing member 102 by way of a main seamless connections 103/103A. In the first embodiment of the invention, the eyelets 101 are fixed to the backing member 102 by ultrasonic welding forming the rectangular shaped the main seamless connection 103/03A in a rectangular shape. The shape of the weld 103/103A depends on the shape of a horn used in the ultrasonic welding machine. The main seamless connection 103A has a well-defined boundary that runs in proximity to and around the leg portion of the eyelets 101.

Referring to FIG. 3B, the backing member 102 includes upper and lower support layer 102A and 102B which are wrapped or concealed by a bottom cover 102C. A front end portion of the bottom cover 102C leads up to a front end portion of an upper side of the upper support layer 102A. A rear end portion of the bottom cover 102C leads up to a rear end portion of the upper side of the upper support layer 102A. The rest of the bottom cover 102C forms a lowermost layer of the eye tape 100. A cover member 104 covers the leg portion of each eyelet 101. The cover member 104 comprises an upper portion 104A and a lower portion 104B connected by a fold. In a preferred embodiment, the leg portions of the pair of eyelets 101 in each row are covered by a same cover member 104. The arrangement will be described in more detail below. The main seamless connection 103A welds the leg portion of each eyelet 101 to corresponding portion of the cover member 104 and the backing member 102. In the preferred embodiment, the cover member 104 and the backing member 102 are fused with the eyelet 101 to form a secured connection. As shown in FIG. 3B, in the main seamless connection 103A, the upper and lower support layer 102A and 102B, an end of the front end portion of the bottom cover 102C are fused to the leg of the eyelet 101 from below. The lower portion 104B of the cover member 104 is fused to the leg of the eyelet 101 from above. The weld is formed from ultrasonic welding. The upper portion 104A of the cover member 104 conceals the main seamless connection 103A as well as the legs of the eyelets 101 from the user. An auxiliary seamless connection 103B is a weld between the backing member 102 and the cover member 104. In more detail, the auxiliary seamless connection 103B in the first row of eyelets 101 is between the upper and lower support layer 102A and 102B, the front end portion of the bottom cover 102C and the lower portion 104B of the cover member 104. The upper portion 104A conceals the auxiliary seamless connection 103B such that it is not viewable from the outside. The auxiliary seamless connection 103B in the second and third row of eyelets 101 is between the upper and lower support layer 102A and 102B as well as the cover member 104 of the preceding row of eyelets 101. The auxiliary seamless connection 103B may be understood as being provided at the periphery of the main seamless connection 103A.

Referring to FIGS. 2, 3A and 3B, during the formation of the eye tapes 100, a first row of eyelets 101 are placed on the end portion of a continuous front end portion of the bottom cover 102C of the backing member 102 with their legs being covered by a continuous first cover member 104. The upper portion 104A of the first cover member 104 extends to form part of the backing member 102 of the second row of eyelets 101 by covering the upper support layer 102A. Each of the eyelets 101 in the first row are fixed in position by respective main seamless connections 103A. There is an opening 113 formed between the folded edge of the first cover member 104 and the front end portion of the backing cover 102C of the backing member 102 via which the eye of the eyelet 101 extends. The auxiliary seamless connections 103B are formed adjacent the main auxiliary seamless connection 103A to fix the relative position of the backing member 102 and the first cover member 104.

After the first row of eyelets 101 are fixed and in place, a second row of eyelets 101 are placed on an extension of the upper portion of the continuous first cover member 104. A continuous second cover member 104 is folded along length to form an upper portion 104A and a lower portion 104B. The legs of the eyelets 101 in the second row are covered by the second cover member 104. The upper portion 104A of the second cover member 104 extends to form part of the backing member 102 of the third row of eyelets 101 by covering the upper support layer 102A. Each of the eyelets 101 in the second row are fixed in position by respective main seamless connections 103A. There is an opening 113 formed between the folded edge of the second cover member 104 and the front end portion of the backing cover 102C of the backing member 102 via which the eye of the eyelet 101 extends. The auxiliary seamless connections 103B are formed adjacent the main auxiliary seamless connection 103A to fix the relative position of the backing member 102 and the second cover member 104.

After the second row of eyelets 101 are fixed and in place, a third row of eyelets 101 are placed on the upper portion 104A of the continuous second cover member 104. A continuous third cover member 104 is folded along length to form an upper portion 104A and a lower portion 104B. The legs of the eyelets 101 in the third row are covered by the third cover member 104. The upper portion 104A of the third cover member 104 extends to cover the rear end portion of the backing cover 102C. The covering member 104 and the backing member 102 remain separated to allow for sewing onto an undergarment. Each of the eyelets 101 in the third row are fixed in position by respective a separate main seamless connections 103A. There is an opening 113 formed between the folded edge of the third cover member 104 and the front end portion of the backing cover 102C of the backing member 102 via which the eye of the eyelet 101 extends. The auxiliary seamless connections 103B are formed adjacent the main auxiliary seamless connection 103A to fix the relative position of the backing member 102 and the third cover member 104.

Thereafter, the continuous eye tape 100 is segregated by ultrasonic cutting into individual eye tapes 100. The left and right sides of each separated eye tape 100 are sealed by or simultaneously with the segregation.

With reference to FIG. 3B, other than the front end portion of the bottom cover 102C, the rest of the bottom cover 102C does not form any part of the main or auxiliary seamless connection such that it remains soft and flexible suitable for direct contact with user. The upper portion 104A of the cover member 104 covers conceals all seamless connections from the user so as to provide an intact finishing.

Figure 4A:
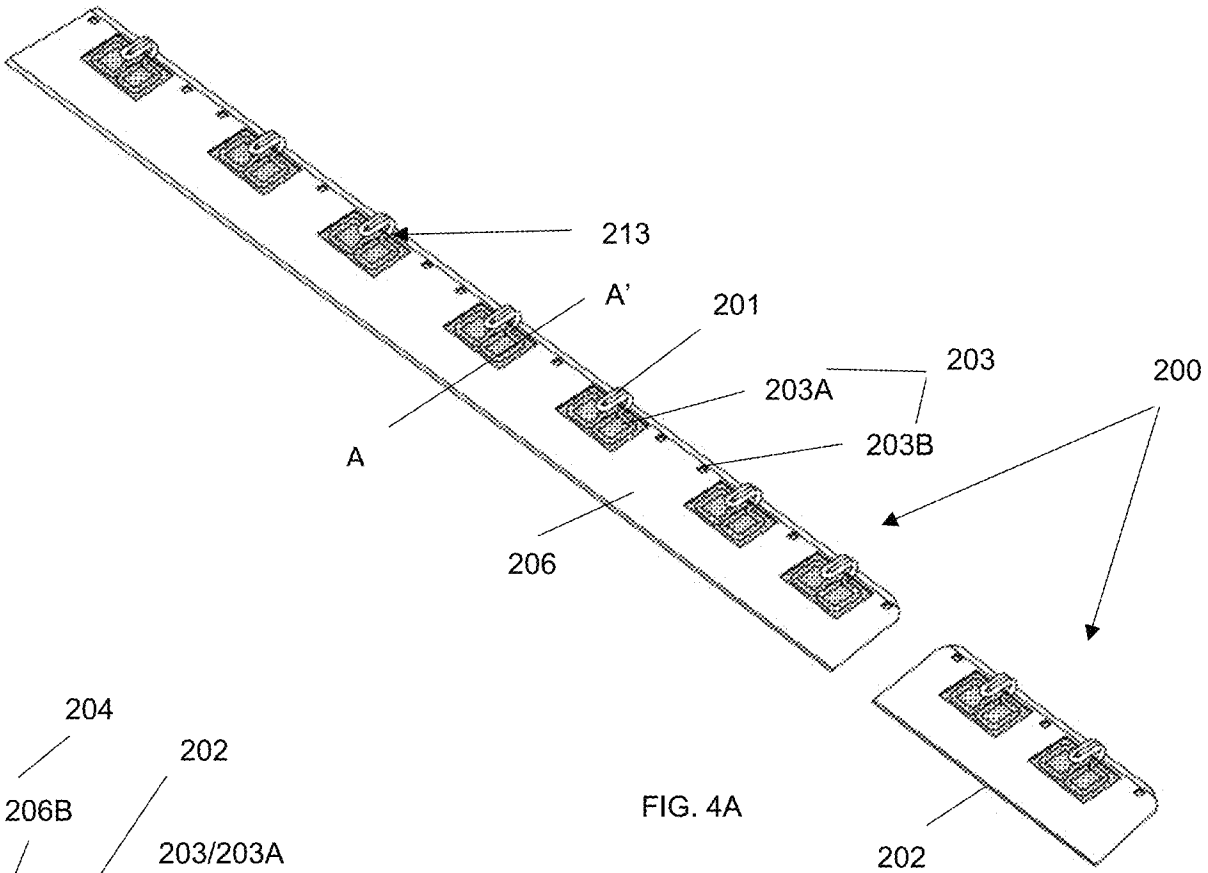
FIG. 4A is a drawing showing a continuous strap of hook tapes in FIG. 1B with the uppermost layer shown transparent to reveal all seamless connections.
Figure 4B:
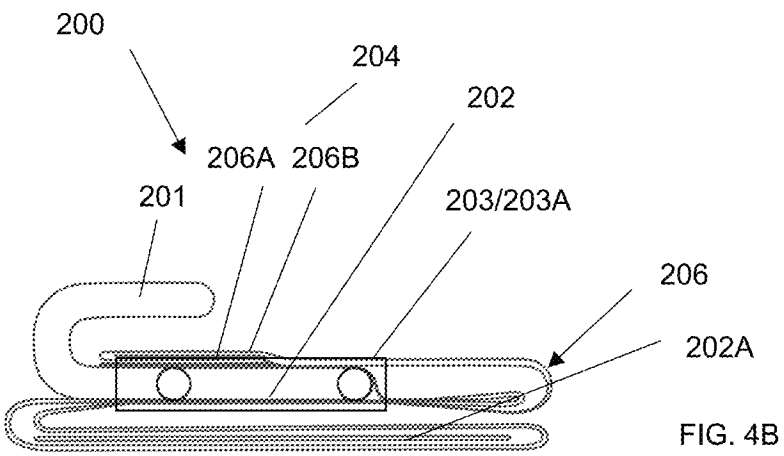
FIG. 4B is a drawing showing a cross-sectional view of the eye tape in FIG. 4A taken along line A-A' thereof.

FIGS. 4A and 4B shows the continuous hook tape which is segregated to form an individual hook tapes 200. Each individual hook tape 200 includes two hooks 201 each a first portion, the legs, sandwiched between a backing member 202 and a cover member 204. The backing member 202 includes a support layer 202A and a portion of a cover sheet 206. The cover sheet 206 is a continuous piece of layer with a main portion that is folded underneath the legs of the hook 201 and wraps around the support layer 202A to form the backing member 202 which comprises layers of materials on which the hooks 201 lie. Front and rear end portions 206A and 206B of the cover sheet 206 overlaps and are being placed on top of the legs of the hooks 201 to form the cover member 204. In other words, different portions of the same cover sheet 206 forms the backing member 202 as well as the cover member 204. The backing member 202 and the cover member 204 are fixed in position and onto the legs of the hook 201 by way of a main seamless connection 203A in the form of an ultrasonic weld. In the main seamless connection 203A, the rear end portion 206A of the cover sheet 206 is fused with the hook 201 from above; and first two layers of the cover sheet 206 that forms the backing member 202 is fused to the hook 201 from below. There are three auxiliary seamless connections 203B. The auxiliary seamless connections 203B are formed adjacent the main auxiliary seamless connection 203A to fix the relative position of the backing member 202 and the cover member 204. The main seamless connection 203A has a well-defined boundary that runs in proximity to and around the leg portion of the hook 201.

Between the backing member 202 and the cover member 204 there is an opening 213 via which the hook portion of the hook 201 extends. The auxiliary seamless connections 203B intended to fix the relative position of the backing member 202 and the cover member 204 relative to one another. The auxiliary seamless connection involves the welding between the front and rear end portions 206A and 206B of the cover sheet 206 and the first two layers of the cover sheet 206 that forms the backing member 202. The auxiliary seamless connection 203B may be understood as being provided at the periphery of the main seamless connection 203A.

In the eye tape 100 and the hook tape 200, the shape of the seamless connections 103 and 203 may be altered according to needs and it is not the intention to limit the shape of the seamless connection 103 and 203 those as shown in the drawings. The position of the seamless connection 103/203 may be adjusted as required.

Figure 5A:
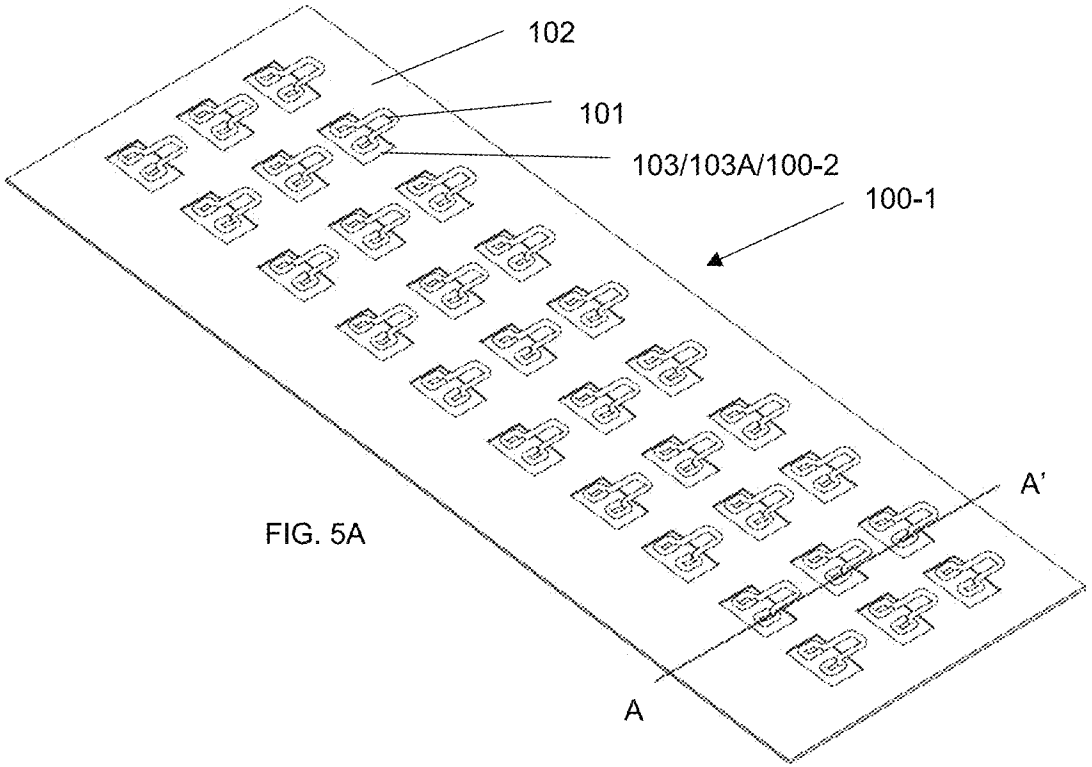
FIG. 5A is a drawing of a continuous strap of a first embodiment of an inner core of an eye tape in accordance with the invention.
Figures 6A, 6B:
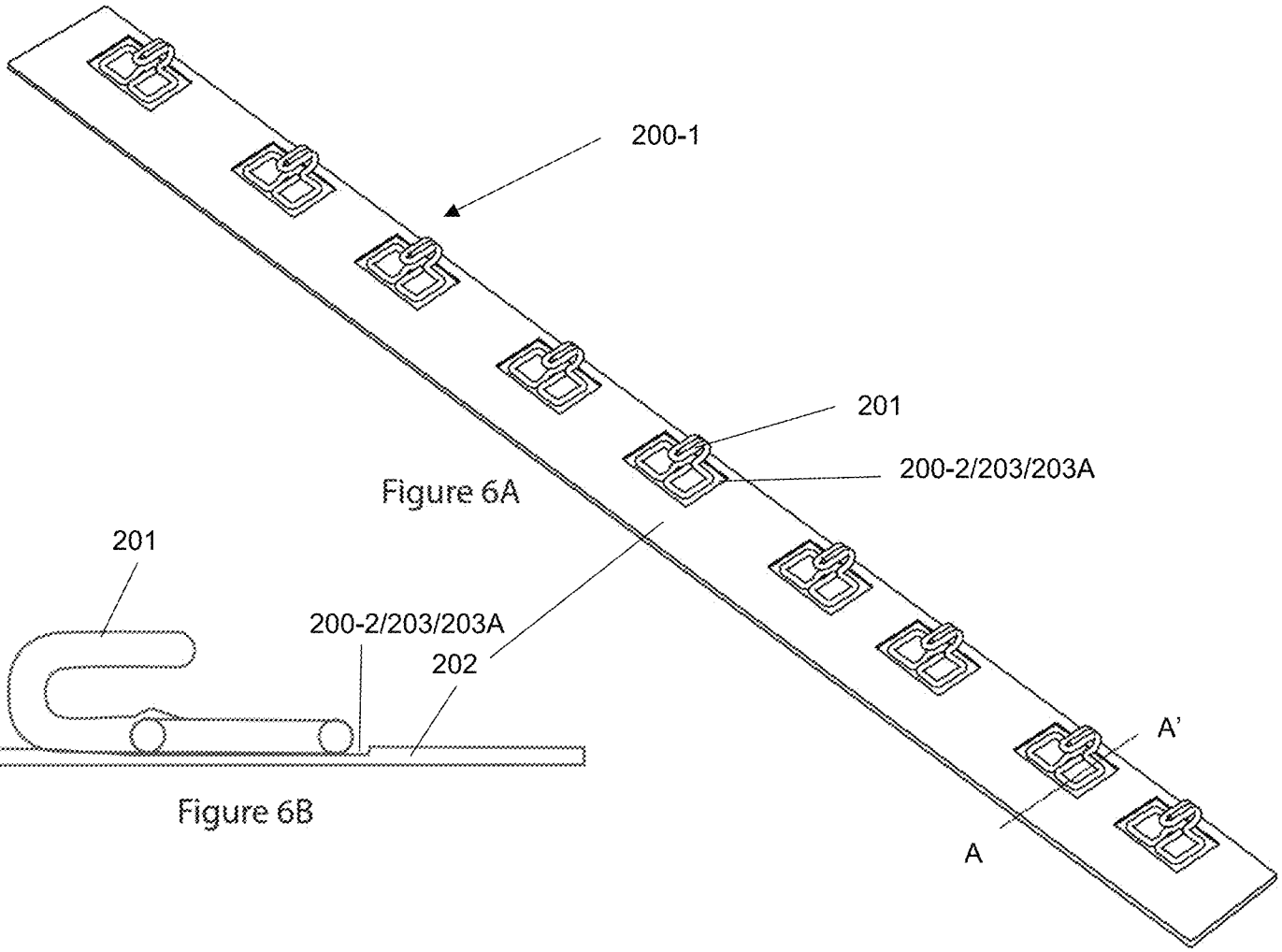
FIG. 6A is a drawing of a continuous strap of a first embodiment of an inner core of a hook tape in accordance with the invention.
FIG. 6B is a drawing showing a cross-sectional view of the inner core in FIG. 6A taken along line A-A'.

FIG. 5A shows a first embodiment of an inner core tape of an eye tape 100 in accordance with the invention. FIG. 6A shows a first embodiment of an inner core of a hook tape 200 in accordance with the invention. The eyelets 101 and hooks 201 on these inner core tapes cooperates to form closures. These inner core tapes may be applied to the eye tape 100 and hook tape 200 in second and third embodiments of the invention as shown in FIGS. 10 to 13D.

Figure 5B:
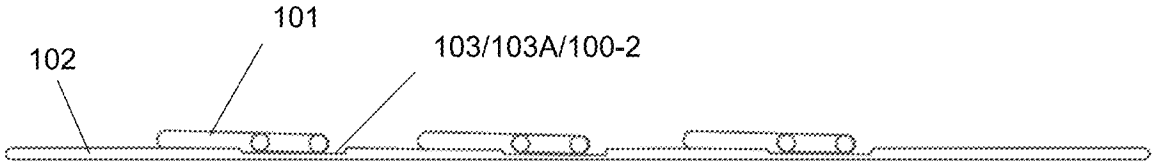
FIG. 5B is a drawing showing a cross-sectional view of the inner core in FIG. 5A taken along line A-A'.

As shown in FIG. 5A, the continuous inner core 100-1 of the eye tape 100 has a backing member 102. On the backing member 102 there are three rows of eyelets 101. Each row of eyelets 101 may include two or more eyelets 101. Each of these eyelets 101 are attached to the backing member 102 at respective attachment regions 103 by way of adhesive which forms the main seamless connection 103A. The main seamless connection 103A has a well-defined boundary that runs in proximity to and around the leg portion of the eyelets 101. The adhesive is preferably a heat sensitive adhesive applied to the legs of the eyelets 101 in the attachment region 100-2 to fix the eyelets 101 to the backing member 102 as shown in FIGS. 5A and 5B. Either, the backing member 102 is formed from a material that can function adhesively or a layer adhesive is coated on the backing member 102. Another possibility is to add an adhesive to the attachment region 100-2 of on the backing member 102 with the eyelet 101 in place. After the seamless connection 103 between the eyelet 101 and the backing member 102 is established, the inner core 100-1 of the eye tape 100 will be used to produce an eye tape 100 e.g. a cover member 104 for sandwiching the legs of the eyelets 101 may be applied to the inner core 100-1. The resulting continuous eye tape 100 will be segregated into individual eye tapes by ultrasonic cutting.

As shown in FIGS. 6A and 6B, a first embodiment of a continuous inner core 200-1 of the hook tape 200 is shown. The inner core 200-1 includes a continuous row of pairs of hooks 201 aligned on a backing member 202. Each hook 201 is individually attached to the backing member 202 at respective attachment region 200-2 by way of adhesive which forms the main seamless connection 203A. The main seamless connection 203A has a well-defined boundary that runs in proximity to and around the leg portion of the hook 201. The adhesive is preferably a heat sensitive adhesive applied to the legs of the hooks 201 in the defined attachment region 200-1 to fix the hooks 201 to the backing member 202 as shown in FIGS. 6A and 6B. After the seamless connection 203 between the hook 201 and the backing member 202 is established, the inner core of the hook tape 200 will be applied to e.g. a cover member 204 to sandwich the legs of the hooks 201 with the backing member 202 and the resulting continuous hook tape 200 will be segregated into individual eye tapes by ultrasonic cutting.

Other ways to adhesively attach the hook 201 to the backing member 202 may involve a backing member 202 that is formed from a material which can function adhesively or a layer adhesive is coated on the backing member 202.

With reference to FIGS. 5B and 6B, in the preferred way of formation of the continuous inner core 100-1 of the eye tape 100 and the hook tape 200, the backing member 102/202 includes predefined attachment regions 100-2/200-2. At least the legs of the eyelets 101 or hook 201 are placed in the attachment regions 100-2/200-2 and adhesive is applied thereto. The adhesive is allowed to cure to form respective main seamless connections 103A/203A such that the eyelets 101 or the hooks 201 are fixed to the backing member 102/202 at respective attachment regions 100-2/200-2 by way of seamless connections 103/203. The predefined attachment region 100-2/103A/203A may be in the form of an indentation or recess on the backing member 102/202.

Figure 7:
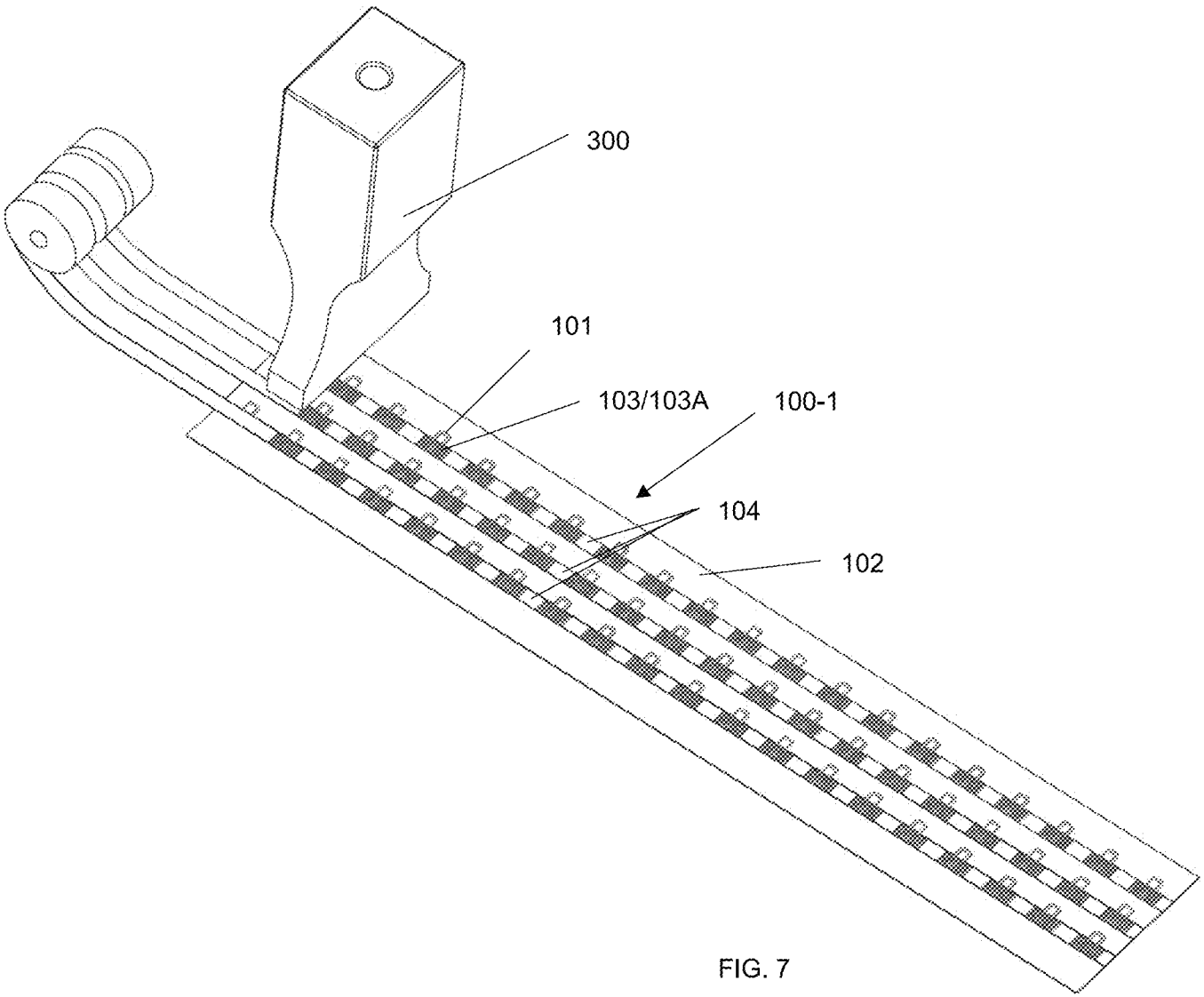
FIG. 7 is an illustrative drawing showing formation of a continuous strap of a second embodiment of an inner core of an eye tape in accordance with the invention.
Figure 8A:
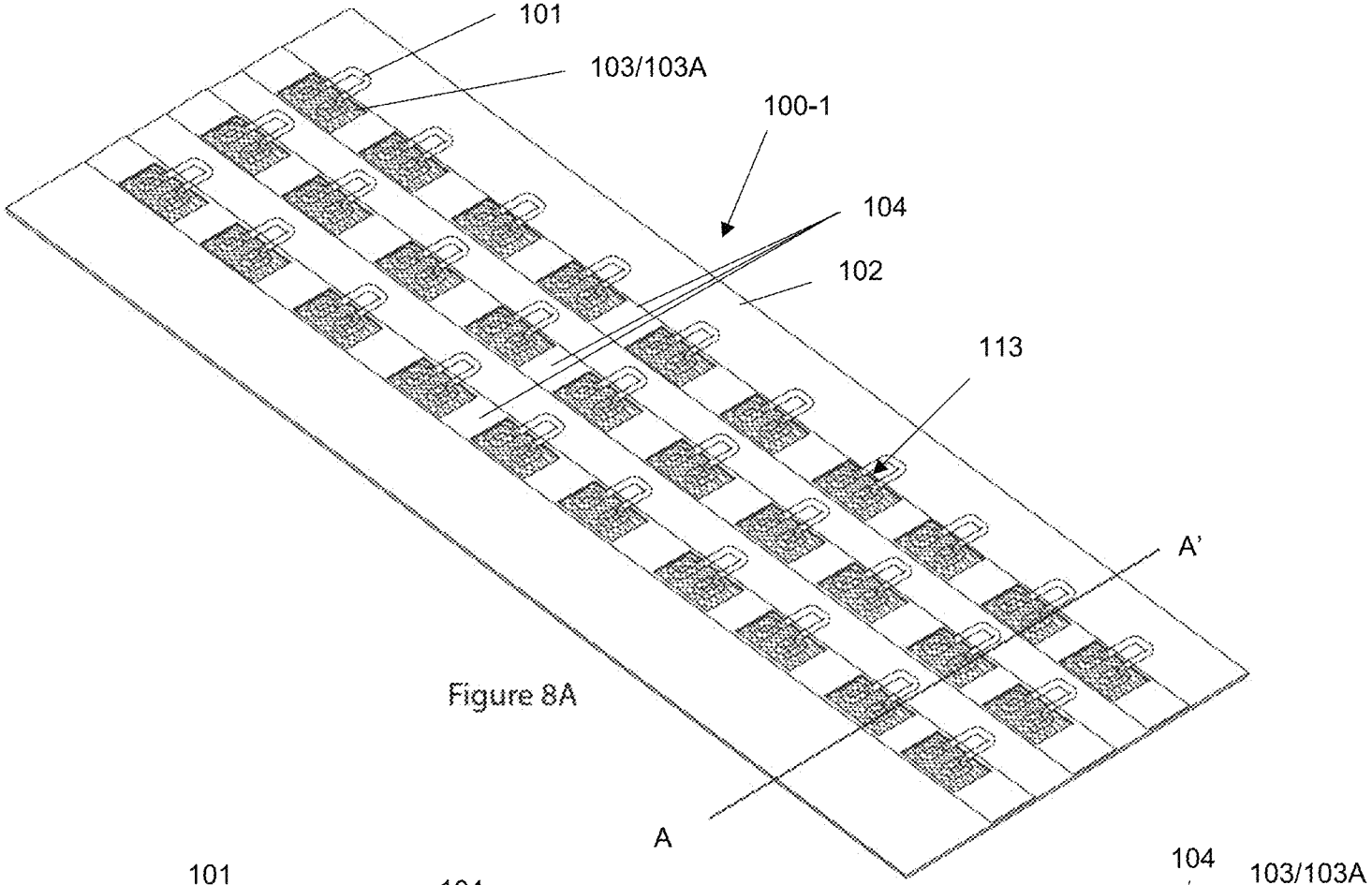
FIG. 8A is a drawing showing the continuous strap of the inner core in FIG. 7.
Figure 8B:
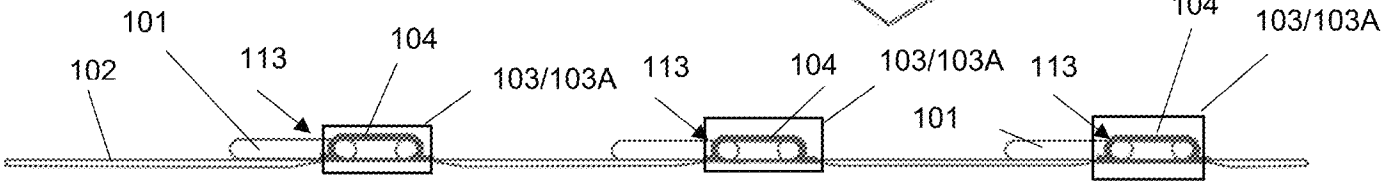
FIG. 8B is a drawing showing a cross-sectional view of the inner core in FIG. 8A taken along line A-A'.
Figure 9A:
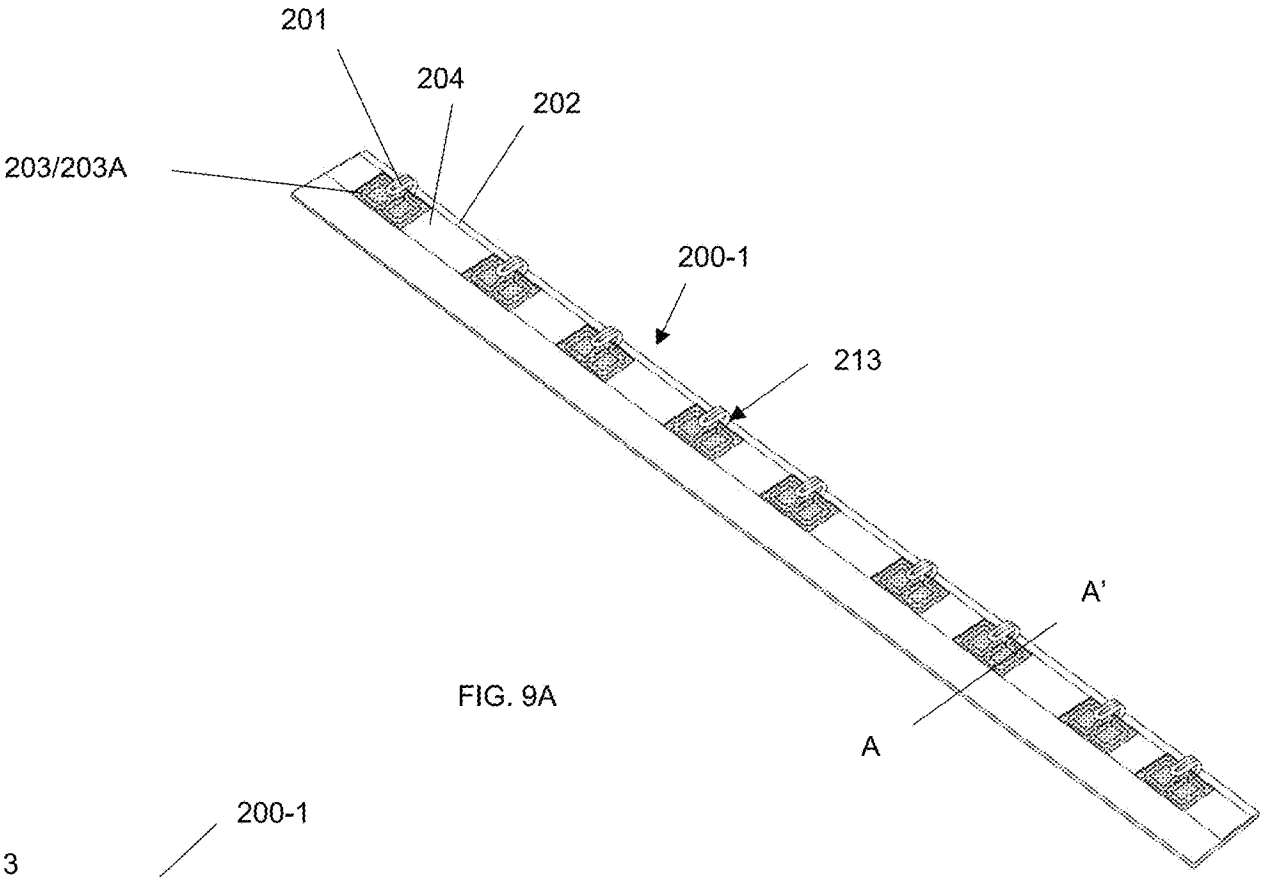
FIG. 9A is a drawing showing a continuous strap of a second embodiment of an inner core of a hook tape in accordance with the invention.
Figure 9B:
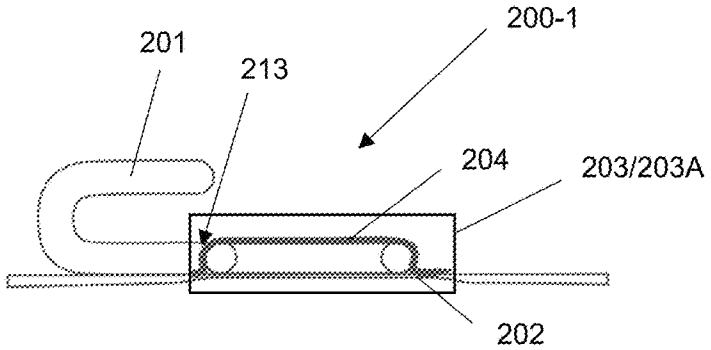
FIG. 9B is a drawing showing a cross-sectional view of the inner core in FIG. 9A taken along line A-A'.

FIGS. 7, 8A and 8B show a second embodiment of an inner core 100-1 of an eye tape 100 in accordance with the invention. FIGS. 9A and 9B show a second embodiment of an inner core 200-1 of a hook tape 200 in accordance with the invention to be used with the eye tape 100 in FIGS. 7, 8A and 8B. These inner core 100-1/200-1 tapes may be applied to the eye tape 100 and hook tape 200 in second and third embodiments of the invention as shown in FIGS. 10 to 13D.

With reference to FIGS. 7, 8A and 8B, a continuous inner core 100-1 of the eye tape 100 is shown. It has a backing member 102. On the backing member 102 there are three rows of eyelets 101. Each row of eyelets may include two or more eyelets 101. Three continuous cover members 104 are provided, one for each row of eyelets 101. The cover member 104 covers the legs of the eyelets 101. Once the backing member 102, the eyelets 101 and the cover members 104 are in place, the backing member 102 is fused to the legs of the eyelets 101 from below by a weld formed from ultrasonic welding. The cover members 104 are fused to the legs of the eyelets 101 in respective rows from above by a weld formed from ultrasonic welding. More specifically, the backing member 102 and the cover member 104 are fused to the eyelets 101. The shape of the weld 103/103A is rectangular but can be anything depends on the shape of a horn 300 used in the ultrasonic welding machine. Each of these welds 103 is a main seamless connection 103/103A that binds the eyelet 101 to the cover member 104 and the backing member 102. Edge of the cover member 104 is in engagement with the backing member 102 and are fused by ultrasonic welding to form part of the main seamless connection 103A. An opening 113 is maintained between the cover member 104 and the backing member 102 for the eye of the eyelet 101 to protrude. The main seamless connection 103A has a well-defined boundary that runs in proximity to and around the leg portion of the eyelets 101.

During the formation of the inner core 100-1 of the eye tape 100, the eyelets 101 are placed on the backing member 102. The cover members 104 are placed on top of the legs of the eyelets 101. As shown in FIG. 7, the horn which is suitable for conducting ultrasonic welding for three eyelets 101 one in each row is placed on top of the cover members 104. The eyelet 101 is ultrasonically welded to the cover member 104 and the backing member 102 on respective sides. A well-defined seamless connection 103 is formed. Each eyelet 101 is attached or welded to corresponding portion of the backing member 102 and cover member 104 by separate main seamless connection 103A. The resulting continuous inner core 100-1 is used to form a continuous eye tape 100 that is segregated into individual eye tapes 100 by way of ultrasonic cutting.

With reference to FIGS. 9A and 9B, the continuous inner core 200-1 of the hook tape 200 includes a continuous row of pairs of hooks 201 aligned on a backing member 202. A continuous cover member 204 is provided to cover the legs of each hook 201 in the row. Ultrasonic welding is performed such that each hook 201 is individually fixed by respective main seamless connections 203/203A to the backing member 202 and the cover member 204. The horn 300 of the ultrasonic welding machine defines a well-defined main seamless connection 203/203A. In the main seamless connection 203A, the backing member 202 is fused to the leg of the hook 201 from below and the cover member 204 is fused to the leg of the hook 201 from above. Edge of the cover member 204 is in engagement with the backing member 202 and are fused by ultrasonic welding to form part of the main seamless connection 203. An opening 213 is maintained between the cover member 204 and the backing member 202 for the hook portion of the hook 201 to protrude. The main seamless connection 203A has a well-defined boundary that runs in proximity to and around the leg portion of the hooks 201.

During the formation of the inner core 200-1 of the hook tape 200, the hooks 201 are placed on the backing member 202. The cover members 204 are placed on top of the legs of the hooks 201. The hook 201 is ultrasonically welded to the cover member 204 and the backing member 202 on respective sides. A well-defined main seamless connection 203A is formed. Each hook 201 is attached or welded to corresponding portion of the backing member 202 and cover member 204 by separate main seamless connection 203A. The resulting continuous inner core 200-1 is used to form a continuous hook tape 200 that is segregated into individual hook tapes 200 by way of ultrasonic cutting.

The shape of the main seamless connection 103A/203A depends on the shape of a horn used in the ultrasonic welding machine.

FIGS. 10, 11A, 11B, 12A and 12B show a second embodiment of the hook and eye tape 200 and 100 in accordance with the invention. The hook and eye tapes 200 and 100 when coupled forms a closure.

Figure 10:
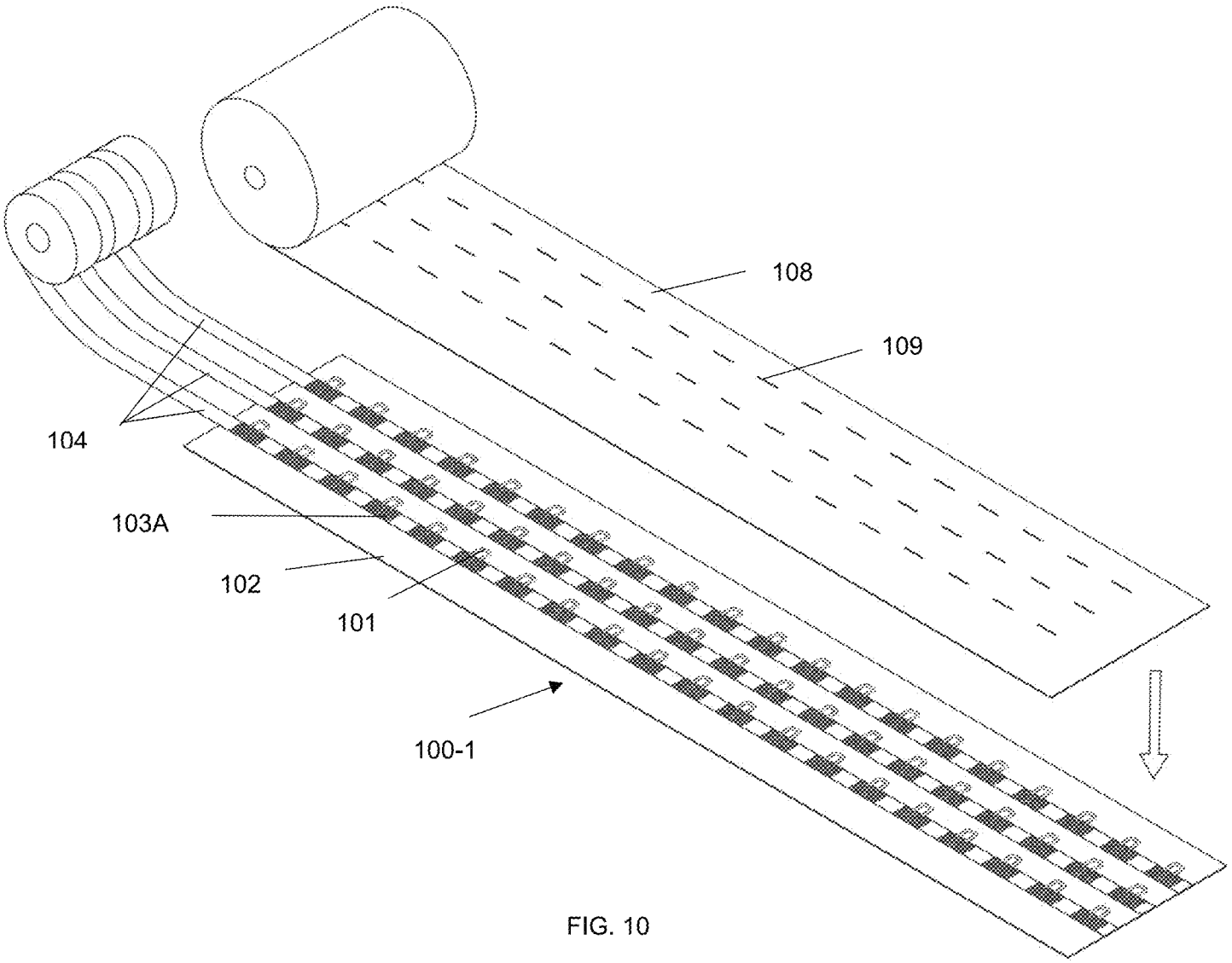
FIG. 10 is an illustrative drawing showing a step in the formation of a continuous strap of a second embodiment of an eye tape in accordance with the invention.

With reference to FIG. 10, the second embodiment of eye tape 100 makes use of the second embodiment of the inner core 100-1 of FIG. 8A. The inner core 100-1 is covered by an outer cover layer 108. The outer cover layer 108 includes a plurality of preformed apertures or punch holes 109. The positions of the apertures or punch holes 109 correspond to the positions of the eyelets 101 on the inner core 100-1.

Figure 11A:
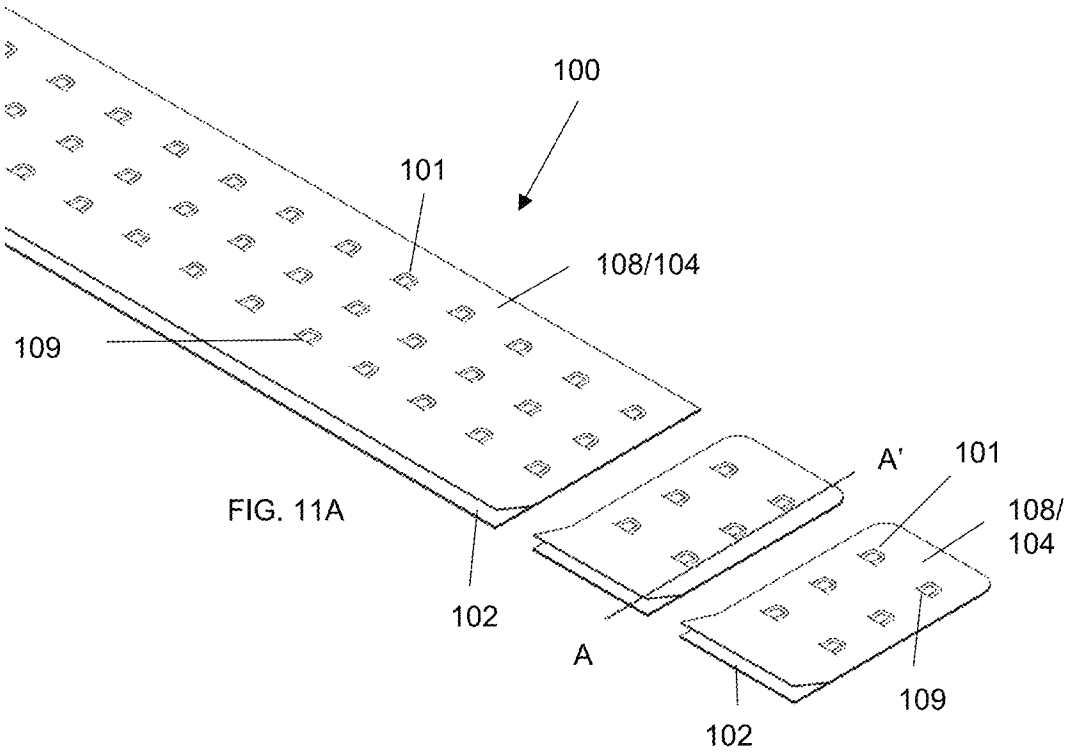
FIG. 11A is a drawing showing the segregation of the continuous strap of the second embodiment of the eye tape in FIG. 10.
Figure 11B:
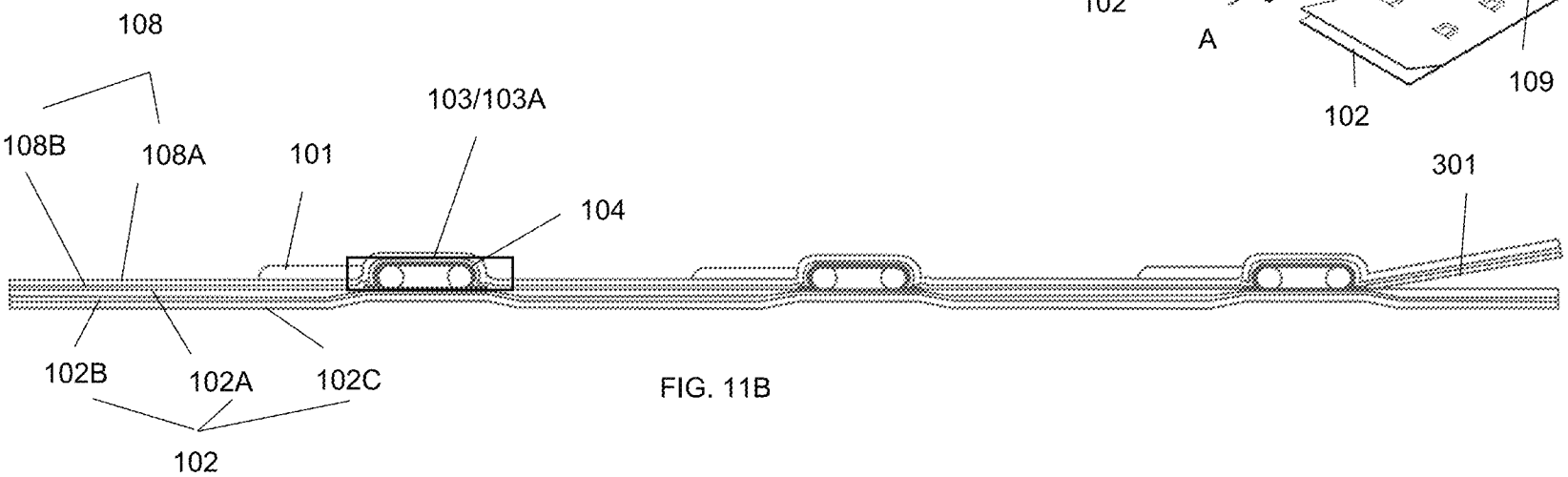
FIG. 11B is a drawing showing a cross-sectional view of the eye tape in FIG. 11A take along line A-A' thereof.

FIG. 11A shows a continuous eye tape 100 of the second embodiment. The leg portions of the eyelets 101 and the main seamless connection 103A are concealed by the outer cover layer 108. The eye portion of each eyelet 101 is placed on top of the outer cover layer 108 via the aperture or punch holes 109. In other words, the eye portions extend through the apertures or punch holes 109 to reach the upper layer 108A. With reference to FIGS. 11A and 11B, in a preferred embodiment, the outer cover layer 108 includes an upper layer 108A and a layer of heat sensitive adhesive 108B. The apertures or punch holes 109 extends through both layers 108A and 108B. The layer of heat sensitive adhesive 108B attaches the upper layer 108A to the backing member 102. The backing member 102 includes a support layer 102A, a layer of heat sensitive adhesive 102B and a bottom cover 102C. The layer of heat sensitive adhesive 102B attaches the support layer 102A to the bottom cover 102C. The continuous eye tape 100 is segregated into individual eye tapes 100 by ultrasonic cutting which simultaneously weld left and right sides of the individual eye tapes 100. As can be seen from FIG. 11A, a rear portion of the individual eye tape 100 is not welded at its left and right sides leaving an open end. A support layer 301 is inserted and attached to an underside of the cover member 104 by the layer of heat sensitive adhesive 108B to enhance rigidity of the rear portion of the individual eye tape 100. The support layer 102A, the cover member 104 and the eyelets 101 are that of the inner core 100-1 as shown in FIGS. 8A and 8B. In an alternative embodiment, the inner core 100-1 as shown in FIGS. 5A and 5B may be applied. In that case, the cover member 104 will be omitted.

With reference to FIG. 11B, in the main seamless connection 103, the backing member 102 is fused to the legs of the eyelets 101 from below by a weld formed from ultrasonic welding. The cover member 104 is fused to the legs of the eyelets 101 in respective rows from above by a weld formed from ultrasonic welding i.e. main seamless connection 103A. The shape of the main seamless connection 103A depends on the shape of a horn 300 used in the ultrasonic welding machine. Each of these welds 103 is a main seamless connection 103 that binds the eyelet 101 to the cover member 104 and the backing member 102.

If the layer of heat sensitive adhesive 102B in the cover member 104 is omitted, one or more auxiliary seamless connection 103B may be applied to bind the outer cover layer 108 to the backing member 102. The position of the auxiliary seamless connection 103B may be adjusted according to needs.

During the formation of the eye tape 100, the eyelets 101 are placed on the support layer 102A of the backing member 102. The cover members 104 are placed on top of the legs of the eyelets 101. The eyelets 101 are welded to the backing member 102 and the respective cover member 104. An outer cover layer 108 is then placed on the cover member 104. The eye portion of the eyelets 101 are inserted through the apertures or punch holes 109 to be placed on top of the outer cover member 108. A layer of heat sensitive adhesive 102B and a bottom cover 102C are placed under the support layer 102A. The continuous eye tape 100 is heated such that the heat sensitive adhesive layer 108B in the outer cover layer 108 and the heat sensitive adhesive layer 102B in the backing member 102 function to adhere the outer cover layer 108, the cover member 104 and the backing member 102 together. Then, the resulting continuous eye tape 100 is segregated into individual eye tapes 100 by way of ultrasonic cutting. The sides of the individual eye tapes 100 are simultaneously welded in the ultrasonic cutting step except the rear portion which remains open for sewing onto an undergarment. The outer cover layer 108, the heat sensitive layer 102B and the bottom cover 102C do not form part of the main seamless connection 103A.

Figure 12A:
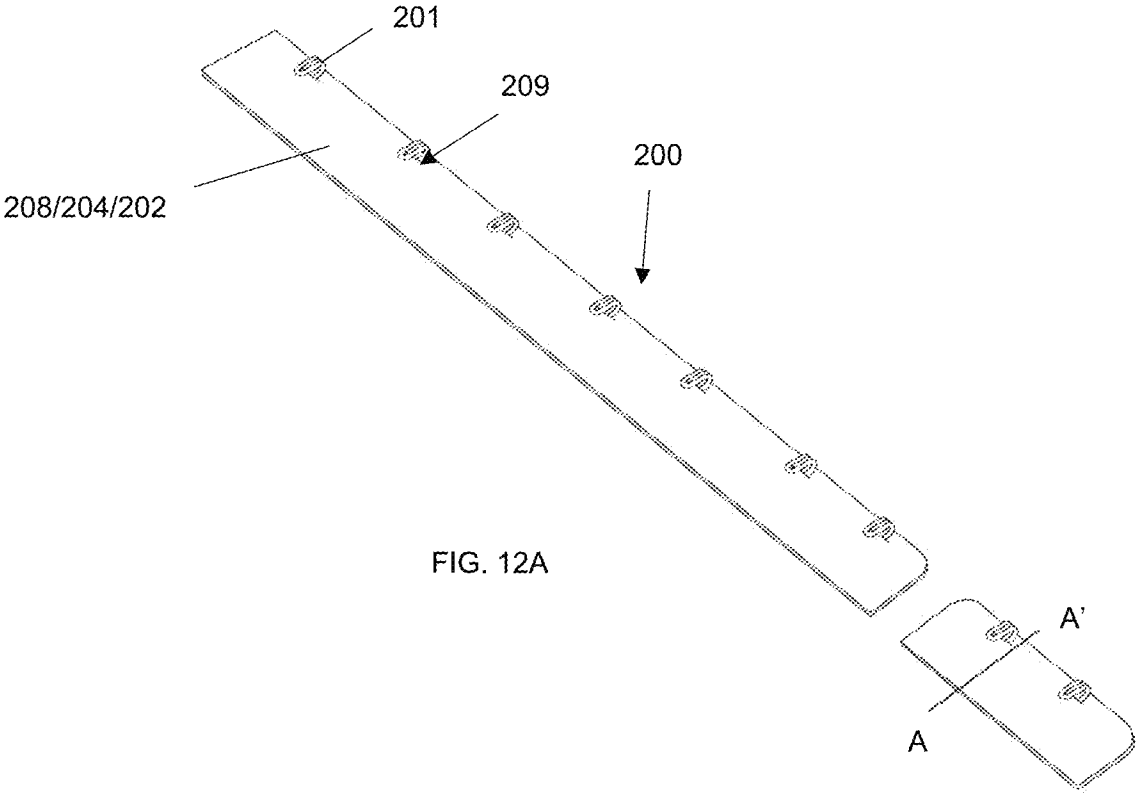
FIG. 12A is a drawing showing the segregation of a continuous strap of a second embodiment of a hook tape for use with the second embodiment of the eye tape in FIGS. 10, 11A and 11B.
Figure 12B:
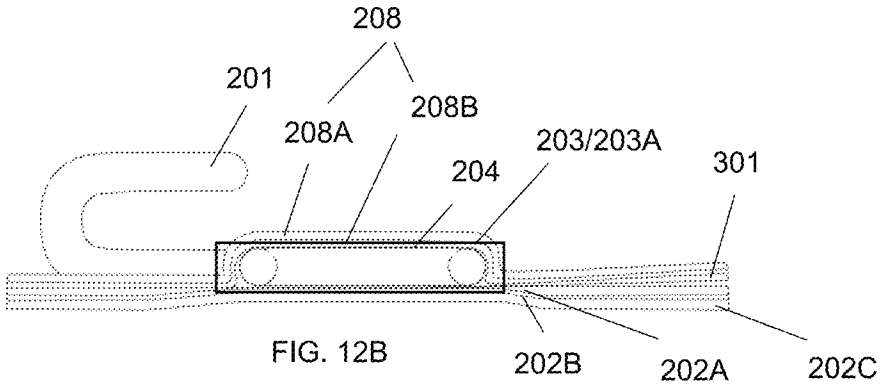
FIG. 12B is a drawing showing a cross-sectional view of the hook tape in FIG. 12A taken along line A-A' thereof.

In FIGS. 12A and 12B there is shown a continuous hook tape 200 of the second embodiment with hooks 201 arranged in pairs aligned into a row. It makes use of the second embodiment inner core 200-1 as shown in FIGS. 9A and 9B. The hooks on the inner core 200-1 have their hook portions lying over the outer cover layer 208 while the outer cover layer 208 conceals their leg portions as well as the main seamless connections 203A. The hook portions of the hook 201 extend through the apertures or punch holes 209 of the outer cover layer 208 to reach the outer cover layer 208. The outer layer 208 includes an upper layer 208A and a heat sensitive layer 208B. When heat applies, the heat sensitive layer 208B fixes the outer cover layer 208 to the cover member 204. The backing member 202 includes a support layer 202A, a heat sensitive layer 202B and a bottom cover 202C. When heat applies, the heat sensitive layer 202B attaches the support layer to the bottom cover 202C. The outer cover layer 208, the heat sensitive layer 202B and the bottom cover 202C do not form part of the main seamless connection 203A.

If the layer of heat sensitive adhesive 202B in the cover member 204 is omitted, one or more auxiliary seamless connection 203B may be applied to bind the outer cover layer 208 to the backing member 204. The position of the auxiliary seamless connection 203B may be adjusted according to needs.

During the formation of the hook tape 200, the hooks 201 are placed on the backing member 202, the support layer 202A. The cover members 204 are placed on top of the legs of the hooks 201. The hooks 201 are welded to the backing member 202 and the respective cover member 204. An outer cover layer 208 is then placed on the cover member 204. The hook portion of the hook 201 are inserted through the apertures or punch holes 209 to be placed on top of the outer cover member 208. A layer of heat sensitive adhesive 202B and a bottom cover 202C are placed under the support layer 202A. The continuous eye tape 200 is heated such that the heat sensitive adhesive layer 208B in the outer cover layer 208 and the heat sensitive adhesive layer 202B in the backing member 202 function to adhere the outer cover layer 208, the cover member 204 and the backing member 202 together. Then, the resulting continuous hook tape 200 is segregated into individual hook tapes 200 by way of ultrasonic cutting. The sides of the individual hook tapes 200 are simultaneously welded in the ultrasonic cutting step except the rear portion which remains open for sewing onto an undergarment. The support layer 202A, the cover member 204 and the hooks 201 are that of the inner core 200-1 as shown in FIGS. 9A and 9B. In an alternative embodiment, the inner core 200-1 as shown in FIGS. 6A and 6B may be applied. In that case, the cover member 204 will be omitted.

Figures 13A, 13B, 13C, 13D:
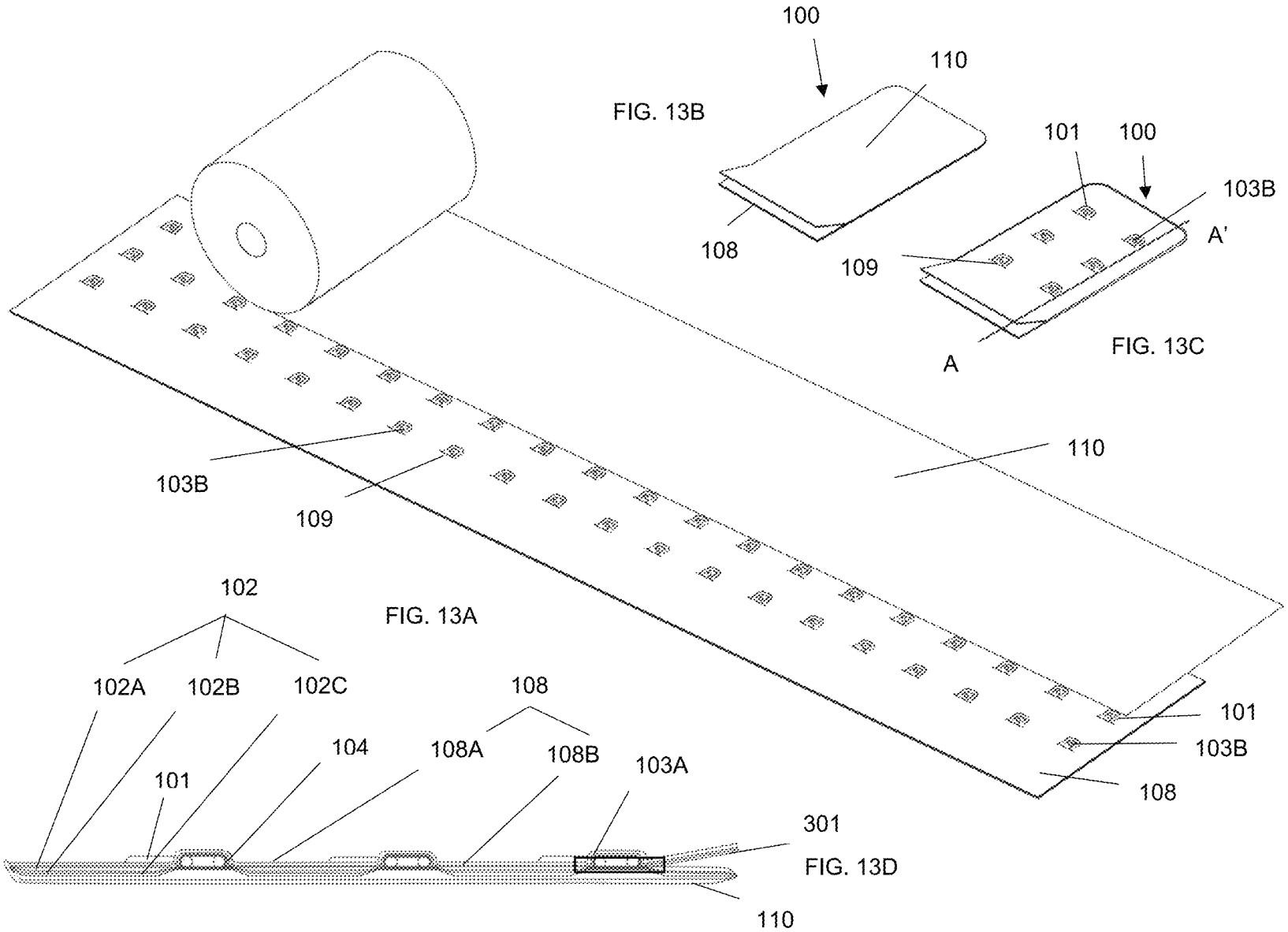
FIG. 13A is an illustrative drawing showing formation of a continuous strap of a third embodiment of an eye tape in accordance with the invention.
FIG. 13B and FIG. 13C are drawings showing back and front sides of the eye tape segregated from the strap in FIG. 13A.
FIG. 13D is a drawing showing a cross-sectional view of the eye tape in FIG. 13C taken along line A-A' thereof.

Referring to FIGS. 13A, 13B, 13C and 13D, there is shown the third embodiment of the eye tape 100 in accordance with the invention. The hook and eye tapes 200 and 100 when coupled forms a closure. The hook and eye tapes 200 and 100 may make use of the hook and eye inner cores 200-1 and 100-1 as shown in FIGS. 5A to 9B With reference to FIG. 13D, three rows of eyelets 101 are placed on a backing member 102 which includes a first support layer 102A, a second support layer 102B and a lower layer 102C. Respective continuous cover members 104 are placed over leg portions of a row of eyelets 101. Respective main seamless connection 103A are formed to secure the leg portion of each eyelet 101 to respective portion of the cover member 104 and the backing member 102. The main seamless connection 103A is a weld formed from ultrasonic welding that fuses or binds the cover member 104 to each eyelet 101 from above. The main seamless connection 103 also fuses or binds all three layers of the backing member 102 to each eyelet 101 from below. The outer cover layer 108 as well as the layer 110 do no form part of the seamless connection 103. An outer cover layer 108 with apertures or punch holes 109 is placed over the cover member 104 and the backing member 102 covering all three rows of eyelets 101. The position of the apertures or punch holes 109 on the outer cover layer 108 correspond to the position of the eyelets 101 on the backing member 102 and the cover member 104. The leg portions of eyelets 101 protrudes via the apertures or punch holes 109 to be placed on top of the outer cover layer 108. The main seamless connection 103 and the legs of the eyelets 101 remain concealed by the outer cover layer 108. The outer cover layer 108 is fixed to the cover member 104 as well as at least part of the backing member 102 via a plurality of auxiliary seamless connections 103B. In the preferred embodiment, the auxiliary seamless connection 103B in the form of an ultrasonic weld is formed between the outer cover layer 108, the cover member 104 and at least the support fabric 102A of the backing member 102 at a position inside of the eye portion of each eyelet 101. The auxiliary seamless connection 103B fixes the outer cover layer 108 to the layers below. The outer cover layer 108 include an upper layer 108A and a heat sensitive adhesive layer 108B. The adhesive layer 108B binds the outer cover layer 108 to the cover member 104 and the backing member 102. With reference to FIG. 13A, a further layer, the outer bottom cover 110 is placed on top of the outer cover layer 108. It conceals all the eye portion of the eyelets. The continuous eye tape 100 is then ultrasonically cut into individual eye tapes 100. The outer bottom cover 110 fuses or binds with at least the outer cover layer 108 at the outer edge on three sides of the eye tape 100. The outer bottom cover 110 has a first side that faces the outer cover member 108 and a second side that faces away from the outer cover layer 108. The outer bottom cover 110 is then flipped or turned inside out such that the second side faces the bottom layer 102C while the first side faces externally away from the bottom layer 102C. The auxiliary seamless connection 103B may be understood as being provided at the periphery of the main seamless connection 103A.

During the formation of the third embodiment eye tape 100, eyelets are placed on the backing member 102. The cover member 104 is placed on the legs of the eyelets 101. Main seamless connections 103A are formed at each eyelet 101. An outer cover layer 108 with apertures 109 is placed on top of the eyelets 101 to conceal the legs of the eyelets 101 and the main seamless connections 103A. The eye portion of the eyelets 101 protrudes via the apertures 109 to be placed on top of the outer cover layer 108. Heat is applied to allow the heat sensitive adhesive layer 108B to adhesively attach the layers adjacent to itself. The second auxiliary connection 103B are formed in the eye portion of each eyelet 101. An outer bottom layer 110 is placed on top of the outer cover layer 108 covering all three rows of eyelets 101. The continuous eye tape 100 is then ultrasonically cut into individual eye tapes 100 fusing the outer bottom layer 110 to the outer cover layer 108 at three sides of the individual eye tapes 100. The bottom layer 110 is then flipped or turned inside out to be placed underneath the bottom layer 102C.

At a rear end portion of the individual eye tape 100, left and right sides remain opened for sewing onto a garment. A support layer 301 is inserted into the rear end portion and attached by the adhesive layer 108B to the upper layer 108A to enhance the rigidity of the rear end portion.

The invention has been given by way of example only, and various other modifications of and/or alterations to the described embodiment may be made by persons skilled in the art without departing from the scope of the invention as specified in the appended claims.

The invention claimed is:

1. A hook or eye tape comprising:

a body including a backing member;

a first connector positioned on the backing member and adjacent to a second connector to form a row; and a first main seamless connection including an area to which a first part of the first connector is secured to the backing member and a second main seamless connection including an area to which a first part of the second connector is secured to the backing member, the first and second main seamless connections are spatially separated from one another, wherein the first and second main seamless connections are covered by an upper portion of a cover member and a lower portion of the cover member, and wherein the upper portion and the lower portion of the cover member are secured to the backing member by a same auxiliary seamless connection.

2. The hook or eye tape of claim 1, wherein the first part of the connector is sandwiched between the upper portion of the cover member and the backing member.

3. The hook or eye tape of claim 1, wherein the auxiliary seamless connection is at a position peripheral to the main seamless connection.

4. The hook or eye tape of claim 1, wherein each main seamless connection comprises a weld, and wherein the welds are formed by way of ultrasonic welding.

5. The hook or eye tape of claim 1, wherein the auxiliary seamless connection is a weld between the backing member, the upper portion of the cover member, and the lower portion of the cover member.

6. The hook or eye tape of claim 1, wherein the first main seamless connection includes a layer of adhesive.

7. The hook or eye tape of claim 6, wherein the layer of adhesive is a heat sensitive adhesive.

8. The hook or eye tape of claim 1, wherein at least one of the backing member, the upper portion of the cover member, and the lower portion of the cover member comprises a layer of heat sensitive adhesive material.

9. The hook or eye tape of claim 3, wherein the auxiliary seamless connection is provided between the first and second main seamless connections for fixing the upper portion and the lower portion of the cover member to the backing member.

10. The hook or eye tape of claim 1, wherein the upper portion of cover member includes an opening through which a second part of the first connector protrudes.

11. The hook or eye tape of claim 1, wherein the upper portion of the cover member is covered by an outer cover layer that is attached to the top cover member via an adhesive layer.

12. The hook and eye tape of claim 1, wherein the first and second main seamless connections are covered by a same upper portion of the cover member.

13. The hook and eye tape of claim 2, wherein the first main seamless connection includes a recess on the backing member for accommodating the first part of the first connector and an adhesive for fixing the first connector to the backing member.

14. The hook and eye tape of claim 13, wherein the first and second main seamless connections each include respective recesses on the backing member for accommodating the first and second connectors.

15. The hook and eye tape of claim 1, wherein the backing member, the upper portion of the cover member, and the lower portion of the cover member are laminated at the first main seamless connection.

16. The hook and eye tape of claim 1, wherein the backing member and the upper portion of the cover member are fused as an inseparable layer at the first main seamless connection.

17. The hook and eye tape of claim 1, wherein the upper portion and the lower portion of the cover member are different portions of a same layer of material.

* * * * *